US010054883B2

(12) United States Patent
Nanjo et al.

(10) Patent No.: US 10,054,883 B2
(45) Date of Patent: Aug. 21, 2018

(54) FIXING DEVICE FOR IMPROVING CHARGING STABILITY OF CHARGER COMPOSED OF ELECTRODE AND SHIELD AND IMAGE FORMING APPARATUS INCLUDING THIS FIXING DEVICE

(71) Applicant: KYOCERA Document Solutions Inc., Osaka (JP)

(72) Inventors: Yuzuru Nanjo, Osaka (JP); Kenichi Kasama, Osaka (JP); Noriaki Furukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 54 days.

(21) Appl. No.: 15/619,769

(22) Filed: Jun. 12, 2017

(65) Prior Publication Data

US 2018/0032011 A1 Feb. 1, 2018

(30) Foreign Application Priority Data

Jul. 27, 2016 (JP) ..... 2016-147222

(51) Int. Cl.
*G03G 15/20* (2006.01)

(52) U.S. Cl.
CPC ..... *G03G 15/2064* (2013.01)

(58) Field of Classification Search
CPC ..... G03G 15/2064; G03G 15/2075; G03G 15/2017
USPC ..... 399/327, 326
See application file for complete search history.

(56) References Cited

U.S. PATENT DOCUMENTS 4,178,092 A * 12/1979 Yamamoto ..... G03G 21/206 250/324
2012/0155938 A1* 6/2012 Tanaka ..... G03G 15/2075 399/335

FOREIGN PATENT DOCUMENTS

JP 2005-338539 A 12/2005
JP 2010002803 A 1/2010

* cited by examiner

*Primary Examiner* — Billy Lactaoen
(74) *Attorney, Agent, or Firm* — Studebaker & Brackett PC

(57) ABSTRACT

A fixing device includes a fixing member, a pressing member, a charger and an air discharging device. The fixing member is rotatably provided and heated by a heat source. The pressing member is rotatably provided and brought into pressure contact with the fixing member to form a fixing nip through which a sheet having a toner image is passed. The charger is disposed to oppose to the fixing member and applies an electric charge of the same polarity as a toner constituting the toner image to a surface of the fixing member. The air discharging device discharges an air flow passed between the fixing member and the charger via a filter.

10 Claims, 6 Drawing Sheets

FIXING DEVICE FOR IMPROVING CHARGING STABILITY OF CHARGER COMPOSED OF ELECTRODE AND SHIELD AND IMAGE FORMING APPARATUS INCLUDING THIS FIXING DEVICE

INCORPORATION BY REFERENCE

This application is based on and claims the benefit of priority from Japanese Patent application No. 2016-147222 filed on Jul. 27, 2016, the entire contents of which are incorporated herein by reference.

BACKGROUND

The present disclosure relates to a fixing device heating and fixing an unfixed toner image formed on a sheet and an image forming apparatus including this fixing device.

Conventionally, an image forming apparatus of an electrographic manner, such as a printer or a copying machine, includes a fixing device heating and fixing an unfixed toner image formed on a sheet and consisting of a fixing member, such as a fixing roller or a fixing belt, and others. In the fixing device, in order to prevent adhesion of a toner onto a surface of the fixing member, a releasing agent, such as Mercapto-modified silicone oil, may be applied to the surface of the fixing member.

In the meanwhile, in the fixing device, there is a problem that, when the toner image is heated and fixed, a volatile substance included in a toner is volatilized and more offensive smell occurs as the volatilized quantity is increased. In addition, in the fixing device, there is also a problem that the volatile substance included in the releasing agent coated to the fixing member is volatilized and then an offensive smell occurs.

In order to cope with these problems, for example, an image forming apparatus may include an air discharging duct discharging an air in the vicinity of the fixing device to the outside of an apparatus body, an adsorbing agent carrying member provided in the middle of an air discharge path in the air discharging duct and an inhalant fan inhaling air in the air discharging duct. In this manner, it is proposed to adsorb and remove the volatile substance, and then, to discharge the air to the outside of the apparatus, thereby reducing the discharged quantity of the volatile substance.

However, in the image forming apparatus, ultra-fine particles and dust (less than 100 nm in particle size) may be discharged, but there is a problem that the ultra-fine particles cannot be sufficiently removed by removal of the volatile substance by the use of the adsorbing agent.

In order to solve such a problem, the image forming apparatus may have electrostatic dust collecting means electrostatically collecting the fine particles and dust produced in the apparatus. The electrostatic dust collecting means includes an electric discharge electrode and a dust collecting electrode and is installed in the air discharging duct disposed in the vicinity of the fixing device. In this manner, it is proposed to electrically charge the ultra-fine particles by electric discharge, and then, to collect them by the dust collecting electrode, thereby collecting the ultra-fine particles produced in the apparatus.

However, as the electrostatic dust collecting means mentioned above, in order to electrically charge the ultra-fine particles floating in air in the air discharging duct by electric discharge, there is a need to apply a large amount of current to a charger and to thereby carry out sufficient electric discharge. In addition, due to the electric discharge, a secondary product, such as ozone or NOx, may be generated and lead to environmental contamination. Thus, there is a need to provide a filter in order to collect the secondary product, and therefore, manufacturing costs is increased.

In addition, the ultra-fine particles may be contained in a wax adhered to the surface of the fixing member, but, if surface temperature of the fixing member is risen, the volatilized quantity and produced quantity of the ultra-fine particles volatilized from the wax may be exponentially increased. By contrast, if the surface temperature of the fixing member is lowered, there is a need to increase width of a fixing nip (a fixing time) in order to appropriately fix the toner image on the sheet. This causes upsizing of a fixing system or increasing of heat capacity, leading to lowering of energy saving property.

SUMMARY

In accordance with the present disclosure, a fixing device includes a fixing member, a pressing member, a charger and an air discharging device. The fixing member is rotatably provided and heated by a heat source. The pressing member is rotatably provided and brought into pressure contact with the fixing member to form a fixing nip through which a sheet having a toner image is passed. The charger is disposed to oppose to the fixing member and applies an electric charge of the same polarity as a toner constituting the toner image to a surface of the fixing member. The air discharging device discharges an air flow passed between the fixing member and the charger via a filter.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
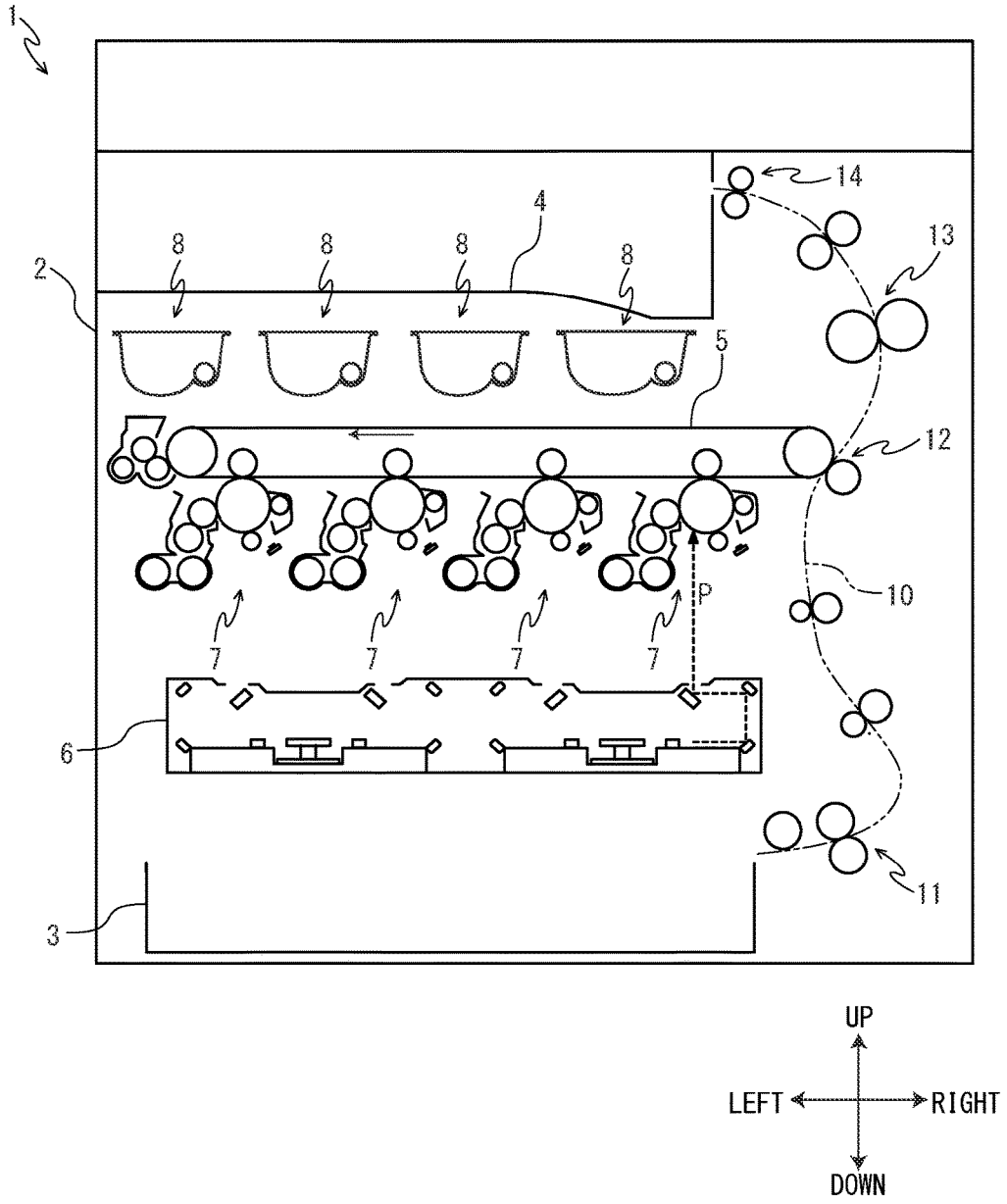
FIG. 1 is a sectional view schematically showing a color printer according to an embodiment of the present disclosure.

First, an entire configuration of a color printer 1 (an image forming apparatus) according to an embodiment of the present disclosure will be described with reference to FIG. 1. Hereinafter, for convenience of description, it will be described so that the front side of the color printer is positioned at the near side on a paper sheet of FIG. 1.

The color printer 1 includes a roughly box-formed printer body 2. In a lower part of the printer body 2, a sheet feeding cartridge 3 storing sheets is provided and, in an upper part of the printer body 2, an ejected sheet tray 4 is provided.

At a central part of the printer body 2, an intermediate transferring belt 5 is windingly stretched among a plurality of rollers. At a lower side of the intermediate transferring belt 5, an exposure device 6 composed of a laser scanning unit (LSU) is provided. Along a lower face side of the intermediate transferring belt 5, four image forming parts 7 are provided for respective toner colors (for example, four colors of yellow, cyan, magenta and black). Each image forming part includes a rotatably photosensitive drum. At the periphery of the photosensitive drum, a charging device, a development device, a primary transferring part, a cleaning device and a static eliminator are disposed in a sequential order of a primary transferring process. At an upper side of development devices of the image forming parts 7, toner containers 8 corresponding to respective image forming parts 7 are provided for the respective toner colors (for example, four colors of yellow, cyan, magenta and black).

At a right side part in the printer body 2, a conveying path 10 of the sheet is provided in upward and downward directions. At an upstream end of the conveying path 10, a sheet feeder 11 is provided. At a middle stream part of the conveying path 10, a secondary transferring part 12 is provided at a right end side of the intermediate transferring belt 5. At a downstream part of the conveying path 10, a fixing device 13 is provided. At a downstream end of the conveying path 10, a sheet ejecting part 14 is provided.

Next, an image forming operation of the color printer 1 as described above will be described. In the color printer 1, image data is inputted and a printing start is directed from an external computer or the like. In each image forming part 7, the photosensitive drum is electrically charged by the charging device, and then, exposed on the basis of the image data by the exposure device 6, and thereby, an electrostatic latent image is formed on the photosensitive drum. The electrostatic latent image on the photosensitive drum is developed for a toner image of each color by the development device. The toner image on the photosensitive drum is primarily transferred to a surface of the intermediate transferring belt 5 by the primary transferring part. By the four image forming parts 7, the operation described above is repeated, and thereby, a toner image of full color (a color tone image) is formed on the intermediate transferring belt 5. The color toner image is supplied to a secondary transferring part 12 at a predetermined secondary transfer timing by rotation of the intermediate transferring belt 5.

On the other hand, a sheet stored in the sheet feeding cartridge 3 or a manual bypass tray (not shown) is picked up by the sheet feeder 11, and then, conveyed on the conveying path 10. Subsequently, the sheet on the conveying path 10 is conveyed to the secondary transferring part 12 at the predetermined secondary transfer timing described above. In the secondary transferring part 12, the color toner image on the intermediate transferring belt 5 is secondarily transferred to the sheet. The sheet having the secondarily transferred color toner image is conveyed to the fixing device 13 on the conveying path 10 and the color toner image is fixed to the sheet by the fixing device 13. Then, the sheet having the fixed color toner image is ejected from the sheet ejecting part 14 to the ejected sheet tray 4.

Next, the fixing device 13 of the embodiment will be described with reference to FIG. 2. The fixing device 13 includes a casing 20, a fixing member 21, a pressing member 22, a heating member 23 (a heat source), a charger 24, a temperature sensor 25, an ejecting section 26 and an air discharging device 27. The fixing member 21 and the pressing member 22 are respectively disposed at the left side and the right side across the conveying path 10 and a fixing nip N is formed between the fixing member 21 and the pressing member 22. The heating member 23 is disposed so as to cover the left side of the fixing member 21.

The casing 20 is formed in a substantially box-like shape and constitutes an outer fence of the fixing member 13. Inside of the casing 20, each component of the fixing device 13 is provided and the fixing device 13 is mounted to the inside of the printer body 2 via the casing 20. The casing 20 internally includes an entry guide 20*a* an ejection guide 20*b*. The entry guide 20*a* is configured to guide to the fixing nip N the non-fixed sheet (the sheet before fixing) conveyed to the fixing device 13 via the conveying path 10. The ejection guide 20*b* is configured to guide to the ejecting section 26 the fixed sheet (the sheet after fixing) passed through the fixing nip N.

The fixing member 21 is provided at the left side inside the casing 20 and composed of a fixing roller 30 and a fixing belt 31.

The fixing roller 30 is formed in a columnar shape elongated in a width direction (forward and backward directions) of the sheet orthogonal to a conveyance direction (left and right directions) of the sheet and is mounted to be rotatable around a rotating axis extending in the forward and backward directions. The fixing roller 30 is composed of, for example, a core metal and an elastic layer provided around this core metal. The core metal of the fixing roller 30 is made of metal material, such as SUS, and is formed in a cylindrical shape having a diameter of 20 mm. The elastic layer of the fixing roller 30 is made of elastic material, such as silicone sponge, and is formed to have a thickness of 10 mm.

The fixing belt 31 has a width elongated in the width direction of the sheet and is formed of an endless belt having an outer diameter of 40 mm. The fixing belt 31 is provided around the fixing roller 30, has the same rotating axis as that of the fixing roller 30 and is rotated together with the fixing roller 30. The fixing roller 30 and the fixing belt 31 are slid and rotated in accordance with rotation of the pressing member 22. Moreover, the fixing belt 31 is induction-heated by a magnetic flux generated by the heating member 23.

Figure 2:
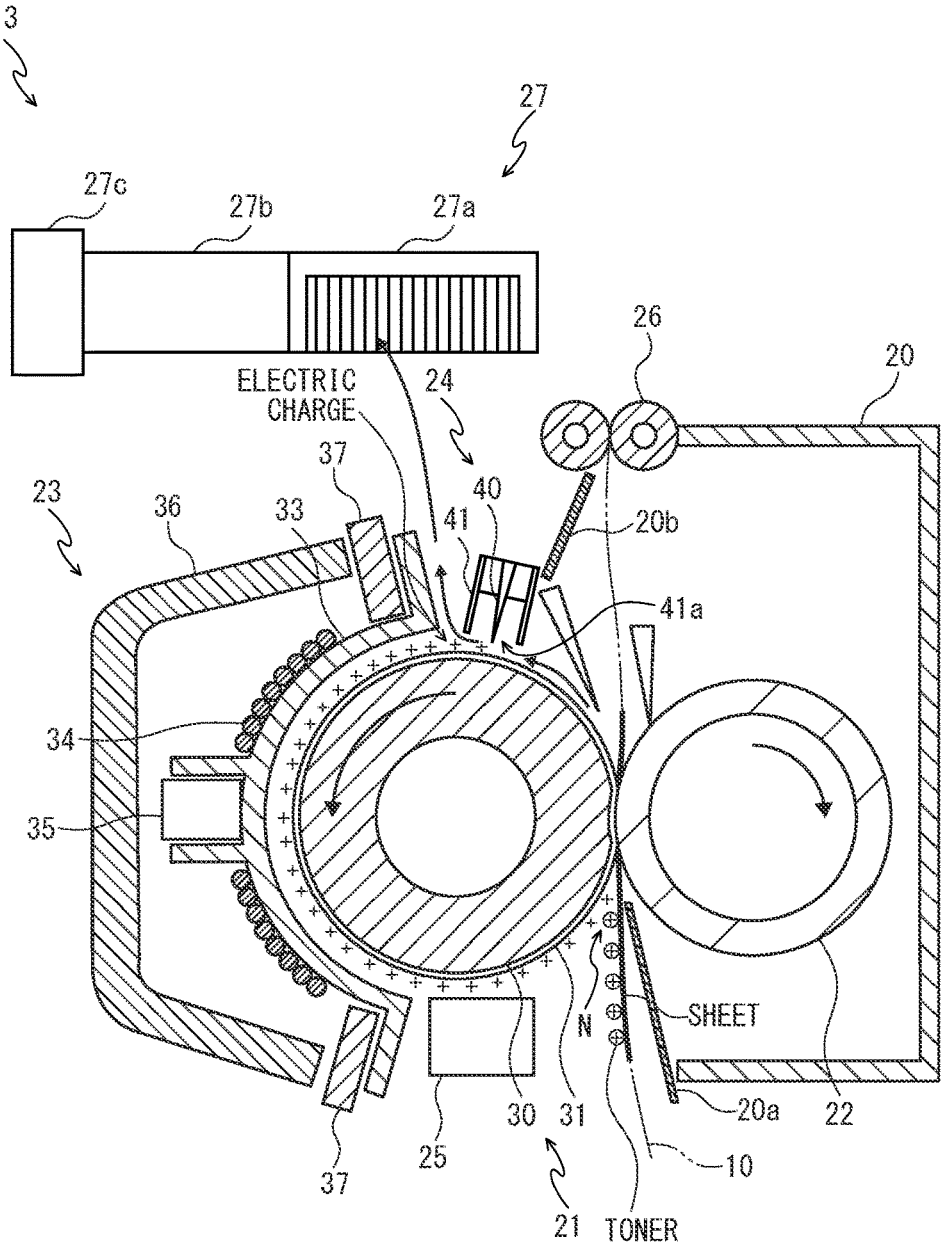
FIG. 2 is a sectional view showing a fixing device according to the embodiment of the present disclosure.

The fixing belt 31 has flexibility and is composed of, for example, a base material layer, an elastic layer provided around this base material layer and a release layer covering this elastic layer, but these layers are not shown in FIG. 2. For example, the base material layer is made of metal material, such as nickel, and is formed to have a thickness of 0.04 mm. The elastic layer is made of elastic material, such as silicone rubber, and is formed to have a thickness of 0.2 mm. The release layer is made of material, such as PFA tube, and is formed to have a thickness of 0.03 mm.

The pressing member 22 is a pressing roller having an outer diameter of 30 mm formed in a cylindrical shape elongated in the forward and backward directions and rotatably mounted. The pressing member 22 is brought into pressure contact with an outer circumferential face of the fixing member 21 (the fixing belt 31), and thereby, the fixing nip N is formed between the fixing member 21 and the pressing member 22. At a rear end of the pressing member 22, a driving gear is fixed, and the pressing member 22 is connected to a driving source (not shown), such as a motor, via the driving gear, and then, is rotationally driven by the driving source.

The pressing member 22 is composed of, for example, a cylindrical core metal, an elastic layer provided around the core metal and a release layer covering this elastic layer, but these layers are not shown in FIG. 2. For example, the core metal of the pressing member 22 is made of metal material, such as aluminum, and is formed to have a thickness of 4 mm. The elastic layer of the pressing member 22 is made of elastic material, such as, silicone rubber, and is formed to have a thickness of 2 mm. The release layer of the pressing member 22 is made of material, such as PFA tube, and is formed to have a thickness of 0.05 mm.

The heating member 23 has a shape of an outer cover in such a manner as to cover the fixing member 21 from the left side and is disposed at the left outside of the fixing member 21. In other words, the heating member 23 is disposed to be space from the fixing belt 31 to the outside by a predetermined distance at an opposite side to the pressing member 22 across the fixing member 21. The heating member 23 includes a bobbin 33, a coil 34, a center core 35, an arch core 36 and two side cores 37. The heating member 23 is an IH fixing unit supplying an electric current to the coil 34 to thereby produce the magnetic flux, and then, causes the magnetic flux to act on the fixing belt 31 to induction-heat the fixing belt 31 (IH: Induction Heat).

The bobbin 33 is elongated in a rotating axis direction of the fixing belt 31 and is a plate member having a sectional arc shape as taken along the shape of a curved face (the left side on the outer circumferential face) of the fixing belt 31. The coil 34 is wound on an outer diameter side face (an outer circumferential face) of the arc shape of the bobbin 33 along the rotating axis direction of the fixing belt 31. That is, the coil 34 is an outer cover-shaped coil formed so as to be taken along the shaft of the curved face (the left side of the outer circumferential face) of the fixing belt 31. Moreover, the coil 34 is an IH coil supplying an electric current as described above to thereby produce the magnetic flux.

The center core 35, the arch core 36 and the two side cores 37 constitute a ferrite member guiding the magnetic flux generated in the coil 34 to the fixing belt 31. Incidentally, the bobbin 33, the center core 35, the arch core 36 and the two side cores 37 are compatible with a case housing the coil 34 as well.

The center core 35 has an elongated shape in the rotating axis direction of the fixing belt 31 and is disposed at a center in the left and right directions on the outer circumferential face of the bobbin 33. The arch core 36 is elongated in the rotating axis direction of the fixing belt 31 and is a plate member having a sectional arc shape of an outer diameter larger than that of the bobbin 33 so as to cover the bobbin 33 and the coil 34 from the left side. The arch core 36 is disposed at the left side (the outside) of the bobbin 33 and the coil 34. Each side core 37 has an elongated shape in the rotating axis direction of the fixing belt 31. The two side cores 37 are respectively disposed at both end sides of the bobbin 33 (both end sides of the arch core 36) and each side core 37 is disposed so as to close a gap between the bobbin 33 and the arch core 36 over each end of the bobbin 33 and each end of the arch core 36.

The charger 24 is composed of a needle electrode 40 and a shield 41, and is disposed at a downstream side from the fixing nip N in the rotation direction of the fixing belt 31.

Figure 3:
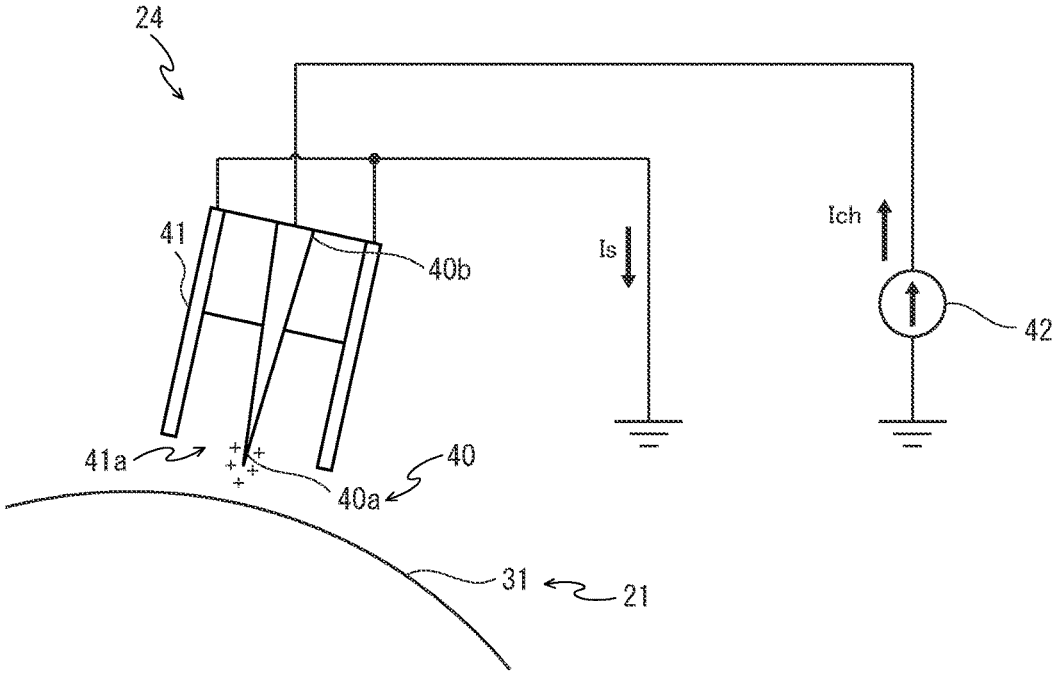
FIG. 3 is a schematic view showing a charger in the fixing device according to the embodiment of the present disclosure.

As shown in FIG. 3 and others, the needle electrode 40 is made of a thin metal plate elongated in a width direction of the fixing belt 31 and is formed in a serrated shape having a plurality of tip ends 40*a*. The needle electrode 40 is arranged, for example, so that the tip ends 40*a* are opposed to a surface of the fixing belt 31 and the tip ends 40*a* are space from the surface of the fixing belt 31 by a gap (for example, 3 to 10 mm, preferably 5 mm). Preferably, the needle electrode 40 is disposed so that the tip ends 40*a* are oriented to a rotation center of the fixing belt 31.

The needle electrode 40 is configured so that a proximal end 40*b* is connected to a power source 42 and voltage (for example, 1.0 KV or more, preferably 2.0 KV) is then applied from the power source 42 to thereby produce corona discharge at each tip end 40*a*. At this time, the power source 42 applies voltage with the same polarity as that of the toner to the needle electrode 40 so that the needle electrode 40 discharges electric charge of the same polarity as that of the toner. That is, the charger 24 applies the electric charge of the same polarity as the toner constituting the toner image to the surface of the fixing member 21 by the electric discharge produced in the needle electrode 40. For example, as shown in FIG. 2, in a case where the toner on the sheet is positively charged, the charger 24 electrically charges the fixing member 21 with a positive electric charge. Therefore, the charger 24 can electrically charge the substance existing in a space between the fixing member 21 and the charger 24 (the substance existing on the surface of the fixing belt 31 at an opposing position between the fixing member 21 and the charger 24) in particular, the foreign matter of ultra-fine particles such as volatile substance, all over the regions in the widthwise direction of the fixing belt 31.

The shield 41 is made of material, such as insulation resin, and is formed in a box-like shape elongated in the width direction of the fixing belt 31. The shield 41 has a tip end aperture 41*a* at least on one face (a lower face) and houses the needle electrode 40 inside so that the tip ends 40*a* of the needle electrode 40 are slightly protruded from the tip end aperture 41*a*. That is, the shield 41 surrounds the periphery of the needle electrode 40. Incidentally, the shield 41 may fix, for example, the needle electrode 40 at both ends in the width direction and more securely fix the needle electrode 40 by filling insulation resin between the needle electrode 40 and the shield 41. The shield 41 is arranged, for example, so that the tip end aperture 41*a* is opposed to the surface of the fixing belt 31 and the end aperture 41*a* is space from the surface of the fixing belt 31 by a gap in order to ensure a sufficient air flow path between the surface of the fixing belt 31 and the charger 24. Preferably, the shield 41 is disposed so that the tip end aperture 41*a* is oriented to the rotation center of the fixing belt 31.

The shield 41 is grounded, and acts so that the electric field exerted by electric discharge produced at the tip ends 40*a* of the needle electrode 40 is uniformly produced all over the regions in the width direction of the fixing belt 31, in the vicinity of the tip end aperture 41*a* of the shield 41, without focusing on only the needle tip. For example, in a relationship between current Ich flowing from the power source 42 to the needle electrode 40 and current Is flowing from the shield 41 to a ground, the current I advancing to the fixing belt 31 becomes Ich-Is and this current I contributes to electric charge control of the fixing belt 31. Incidentally, it is sufficient that the current I is of the order of 0.5 μA, for example, when the current Ich of the order of 5 μA is supplied and the current Is of the order of 90% thereof is supplied, it is possible to stabilize electric discharge exerted by the needle electrode 40.

The temperature sensor 25 senses a surface temperature of the fixing belt 31, is composed of, for example, a thermistor disposed in a noncontact manner with respect to the fixing belt 31, and is disposed at the upstream side from the fixing nip N in the rotation direction of the fixing belt 31.

The ejecting section 26 consists of a pair of ejecting rollers provided at an upper end of the casing 20, and ejects along the carrying path 10 the fixed sheet guided by the ejection guide 20*b*.

The air discharging device 27 is composed of a fan 27*a*, an air discharging duct 27*b* and a filter 27*c*, and is provided at the upper side of the fixing belt 31.

The fan 27*a* is disposed at the downstream side from the charger 24 in the rotation direction of the fixing belt 31. The fan 27*a* is provided so as to inhale the air flow passing through a space between the surface of the fixing belt 31 and the charger 24 at the downstream side from the charger 24. By activating the fan 27*a*, the air flow to be fed to the fan 27*a* from the space between the surface of the fixing belt 31 and the charger 24 is produced, and the air including the substance (foreign matter of the ultra-fine particles) electrically charged by the charger 24 in the space between the surface of the fixing belt 31 and the charger 24 is inhaled by the fan 27*a*. Incidentally, between the side core 37 at the upper side of the heating member 23 and the shield 41 of the charger 24, an air flow path running from the charger 24 to the fan 27*a* may be arranged.

The air discharging duct 27*b* has one end connected to the fan 27*a* and the other end connected to the filter 27*c* to form the air flow feeding the air inhaled by the fan 27*a* to the filter 27*c*. The air discharging duct 27*b* internally includes, for example, a dust collecting electrode (not shown) collecting the charged substance (foreign matter of ultra-fine particles). Although the particles in air fed from the fixing belt 31 are electrically charged basically due to electric discharge exerted by the needle electrode 40, an electric discharge electrode may be additionally disposed in the air discharging duct 27*b* at the downstream side to thereby prospect the improvement of the electric charging capability, making it possible to anticipate the improvement of the effect of capturing the particles in the filter 27*c*. The filter 27*c* is provided, for example, in the vicinity of a wall face of the printer body 2, the air inhaled by the fan 27*a* and passed through the air discharging duct 27*b* is discharged to the outside of the apparatus (the outside of the color printer 1) via the filter 27*c*. The filter 27*c* is composed of a fiber or the like so as to electrostatically absorb and capture the particles (dust) in the air.

Therefore, the air discharging device 27 can remove the substance in the air (electrically charged foreign matter of ultra-fine particles) by the dust collecting electrode and the filter 27*c* in the air discharging duct 27*b*, and can discharge the air after removing the substance to the outside of the apparatus. The efficiency of capturing the dust in the filter 27*c* is, as described above, remarkably improved by forcibly charging the dust by the needle electrode 40.

According to the embodiment, as described above, the fixing device 13 of the color printer 1 includes the fixing member 21, the pressing member 22, the charger 24 and the air discharging device 27. The fixing member 21 is rotatably provided and heated by the heating member 23 (the heat source). The pressing member 22 is rotatably provided and brought into pressure contact with the fixing member 21 to form the fixing nip N through which the sheet having the formed toner image is passed. The charger 24 is disposed to oppose to the fixing member 21 and applies the electric charge of the same polarity as the toner constituting the toner image to the surface of the fixing member 21. The air discharging device 27 discharges the air flow passing through the space between the fixing member 21 and the charger 24 via the filter 27*c*.

In this manner, in the fixing device 13, by opposing the charger 24 to the fixing member 21, it is possible to electrically charge the substance adhered to the surface of the fixing member 21 (the fixing belt 31) at the opposing position between the fixing member 21 and the charger 24 (for example, the foreign matter of ultra-fine particles, such as volatile substance), effectively. Thus, the air discharging device 27 can effectively remove the foreign matter of the ultra-fine particles while realizing energy saving and can prevent an occurrence of offensive smell exerted by the volatile substance. Incidentally, in the embodiment, in order to collect the heated volatile substance, since the air discharging device 27 (the air discharging duct 27*b*) is disposed at the upper side of the fixing member 21, it is possible to improve the efficiency of collecting the volatile substance by utilizing chimney effect. In addition, since the charger 24 supplies the electric charge of the same polarity as the toner to the fixing member 21 (the fixing belt 31), and thus, electrostatic repulsion occurs between the toner and the fixing member 21, the toner is hardly adhered to the fixing member 21. Therefore, it is possible to prevent an electrostatic offset phenomenon exerted by adhesion of the toner to the fixing member 21.

Further, according to the embodiment, the charger 24 is disposed at the downstream side from the fixing nip N in the rotation direction of the fixing member 21.

If the volatile substance of ultra-fine particles remains on the surface of the fixing member 21 (the fixing belt 31) after fixing process, the volatile substance is prone to volatilize by being heated at the downstream side from the fixing nip N. However, by disposing the charger 24 at the downstream side from the fixing nip N, it is possible to electrically charge the remaining ultra-fine particles immediately before volatilizing, effectively.

Figure 4:
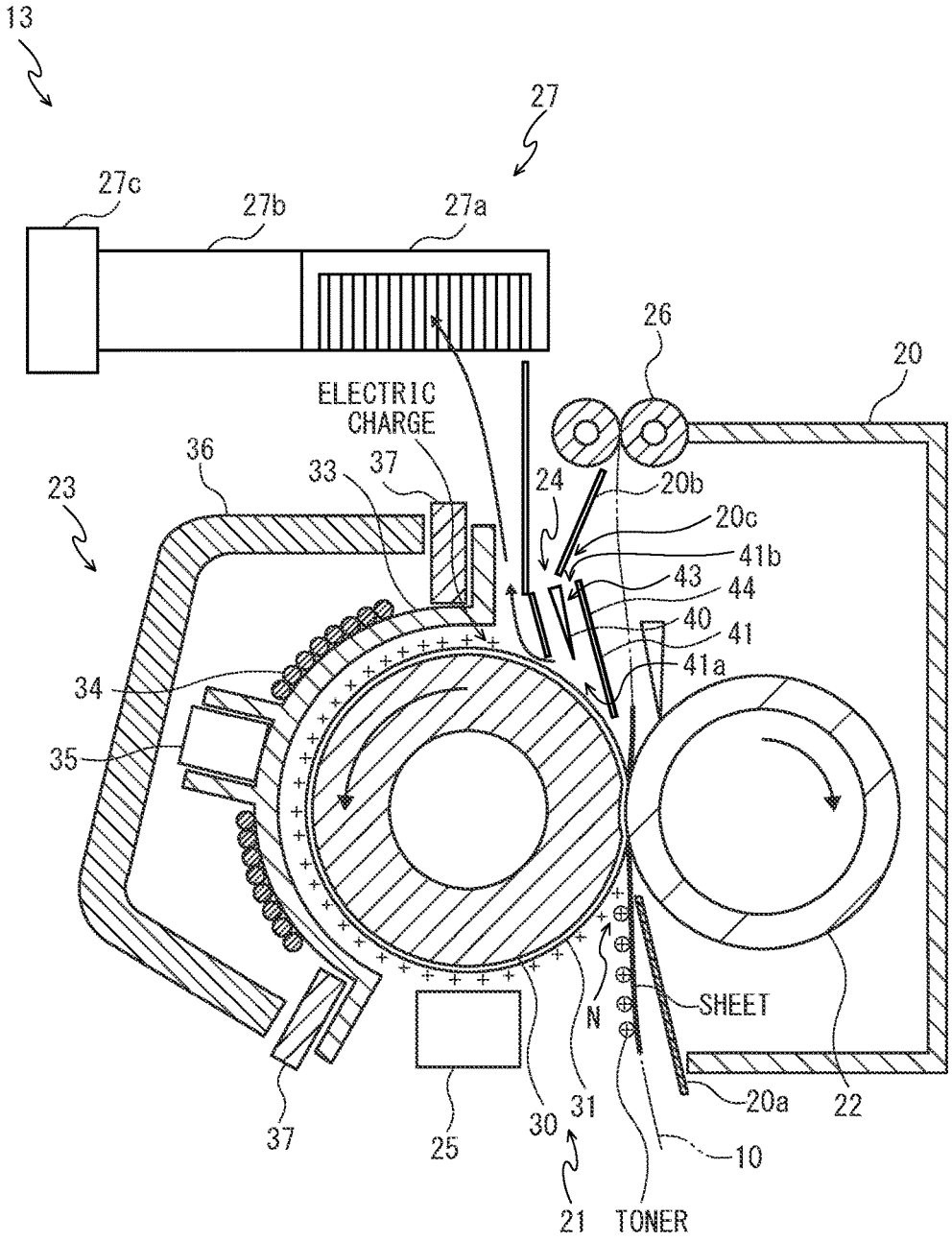
FIG. 4 is a sectional view showing a fixing device according to the other embodiment of the present disclosure.
Figure 5:
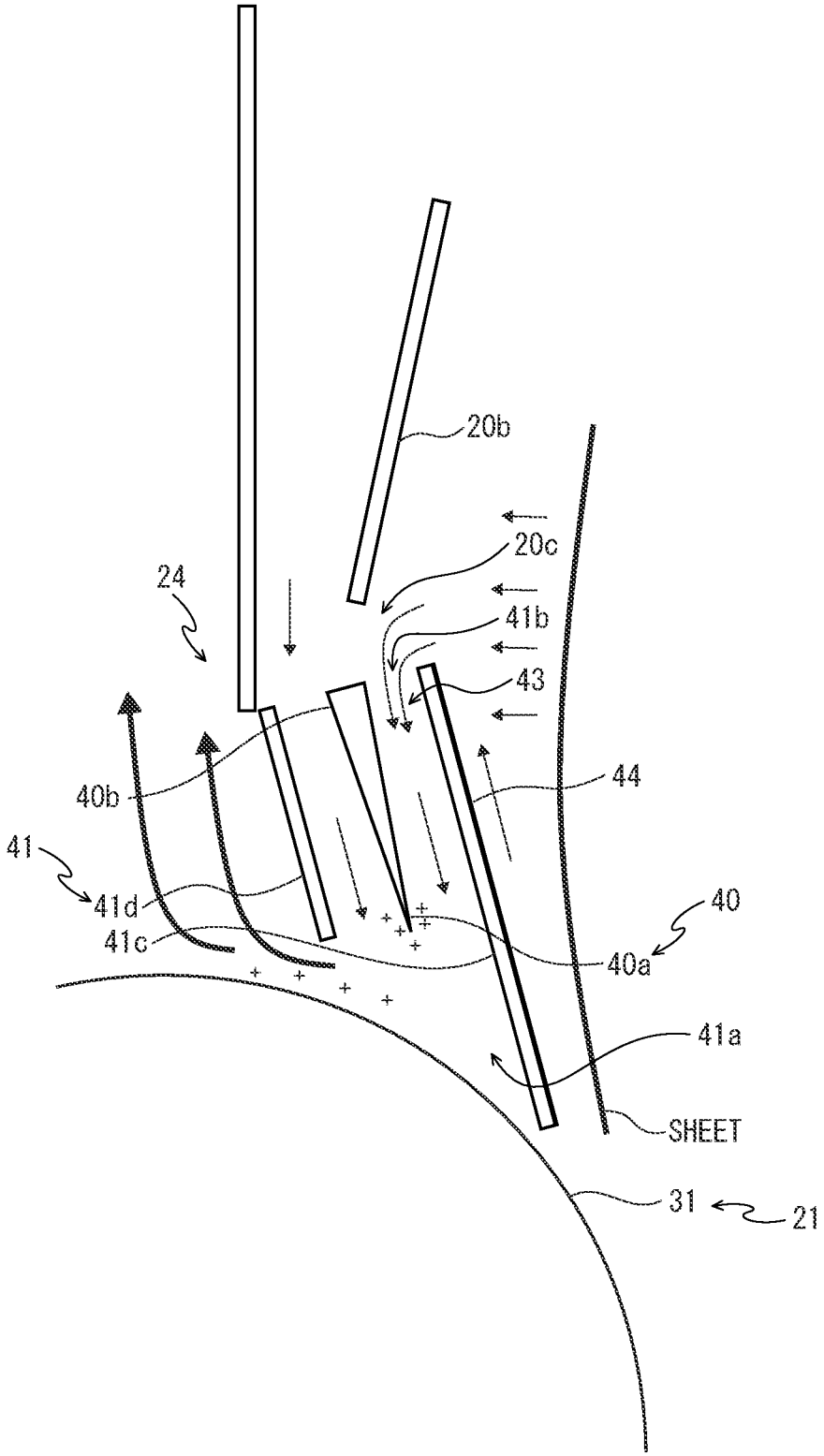
FIG. 5 is a schematic view showing a charger in the fixing device according to the other embodiment of the present disclosure.
Figure 6:
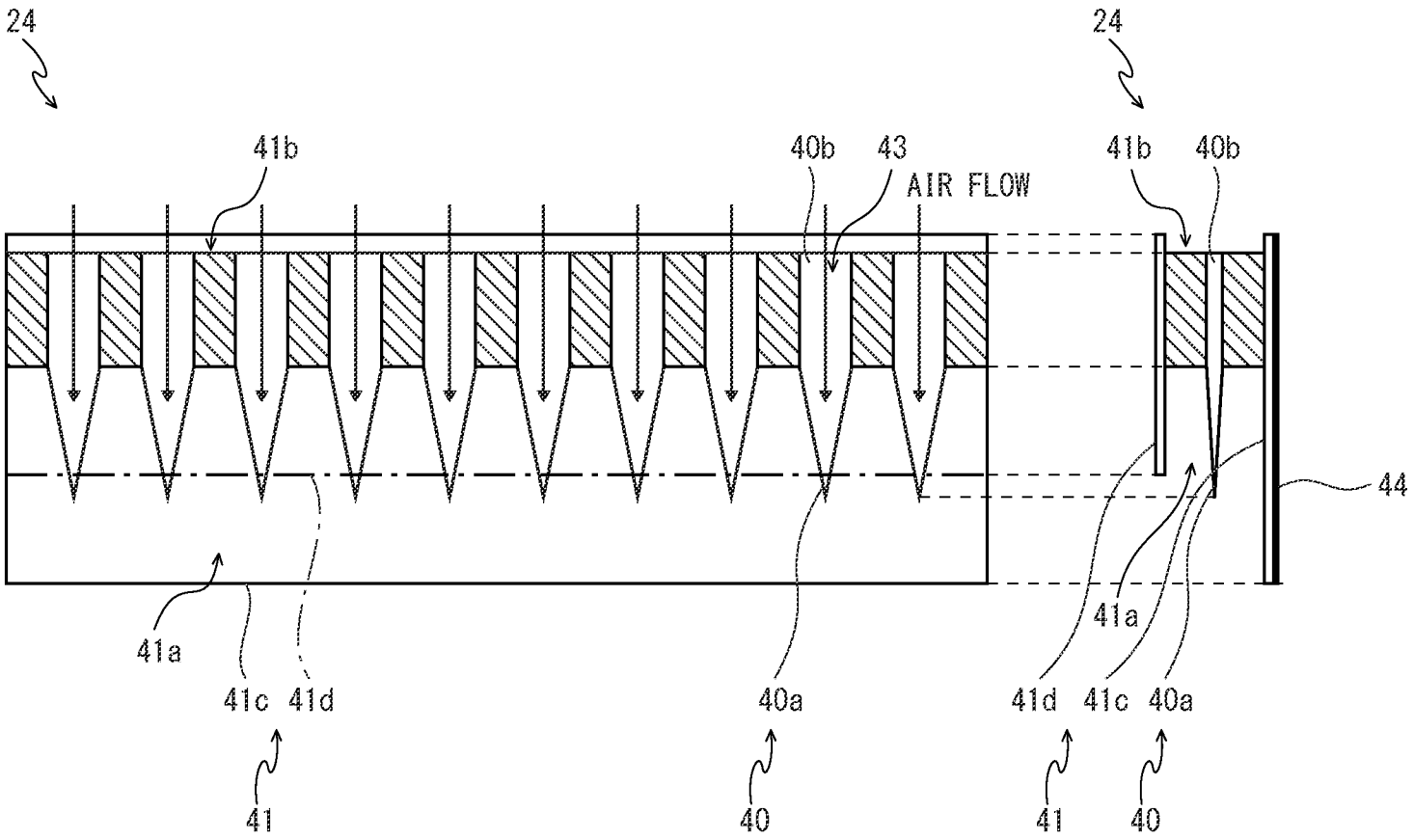
FIG. 6 is a front sectional view and a lateral sectional view showing the charger in the fixing device according to the other embodiment of the present disclosure.

Although, in the embodiment as described above, a configuration filling insulation resin between the needle electrode 40 and the shield 41 in the charger 24 of the fixing device 13 was described, the configuration of the charger 24 is not restricted by this. For example, in the other embodiment, the charger 24 further includes, as shown in FIGS. 4 to 6, an intake port 43 taking the air in at the proximal end 40*b*'s side of the needle electrode 40 between the needle electrode 40 and the shield 41.

The intake port 43 of the charger 24 communicates to the air discharging device 27 via the tip end aperture 41*a* of the shield 41 at the tip ends 40*a*'s side of the needle electrode 40. In such a case, the shield 41 is provided with not only the tip end aperture 41*a* on one face (the lower face) at the tip ends 40*a*'s side of the needle electrode 40, but also a proximal end aperture 41*b* on another face (an upper face) at the proximal end 40*b*'s side of the needle electrode 40. That is, the intake port 43 is provided at the proximal end aperture 41*b*'s side of the shield 41.

In this manner, since, between the needle electrode 40 and the shield 41, the air flow feeding the air via the intake port 43 is arranged, it is possible to improve charging stability of the charger 24. If the air were stagnated around the electrode carrying out electric discharge, because the charged (ionized) particles by electric discharge may be accumulated around the electrode, this electric charge may impede forming of the electric field and electric discharge may hardly occur. However, by providing the intake port 43 to flow the air around the needle electrode 40, it is possible to eliminate the accumulated state of the charged particles and to accelerate electric discharge.

Incidentally, in the other embodiment described above, not only the tip end aperture 41*a* of the shield 41 is oriented to the surface of the fixing member 21 (the fixing belt 31), but also the proximal end aperture 41*b* of the shield 41 is provided in the vicinity of the downstream side (a discharge side) from the fixing nip N in the conveyance direction of the sheet. In addition, the ejection guide 20*b* of the casing 20 is provided with a guiding aperture 20*c* in the vicinity of the proximal end aperture 41*b* of the shield 41. The guiding aperture 20*c* may be configured by shifting the ejection guide 20*b* from the shield 41 or may be configured by drilling the ejection guide 20*b*.

In this manner, the air containing much volatile substances of the ultra-fine particles in the vicinity of the ejecting section 26 ejecting the sheet after fixing process can be taken in via the guiding aperture 20*c* of the ejection guide 20*b* and the proximal end aperture 41*b* (the intake port 43) of the shield 41. Subsequently, it is possible to feed the thus taken-in air to the tip ends 40*a*'s side of the needle electrode 40 carrying out electrically-charging. Therefore, it is possible to improve the capability of repairing the substance of the ultra-fine particles.

In addition, although, in the embodiment as described above, a configuration in which the charger 24 of the fixing device 13 is disposed to oppose the tip end aperture 41*a* of the shield 41 to the surface of the fixing belt 31 in the orientation to the rotation center of the fixing belt 31 was described, the configuration of the charger 24 is not restricted by this. For example, in the other embodiment, the charger 24 is configured, as shown in FIGS. 4 to 6 so that a first wall 41*c* at the conveying path 10's side of the shield 41 is compatible with a separating member (a separator) separating the sheet from the fixing belt 31.

To a wall face at the conveying path 10's side of the first wall 41*c* as the separating member, a coating 44 with material of low frictional coefficient, such as PTFE, is applied. By providing the coating 44, it is possible to reduce a conveyance load of the sheet separated from the fixing member 21 (the fixing belt 31) and to prevent fusion of the toner to the first wall 41*c* and the sheet.

The needle electrode 40 and the shield 41 are disposed so as to oppose to the surface of the fixing belt 31 in the orientation to the fixing nip N, and the first wall 41*c* of the shield 41 is disposed along the conveying path 10. In addition, the first wall 41*c* of the shield 41 is disposed while a tip end thereof has a gap of 0.2 to 0.6 mm from the surface of the fixing belt 31 so as to be suitable for separation of the sheet. On the other hand, a second wall 41*d* at an opposite side to the conveying path 10 of the shield 41 is disposed while a larger gap than the former gap is spaced from the surface of the fixing belt 31 in order to ensure a sufficient air flow path between the surface of the fixing belt 31 and the charger 24.

That is, the first wall 41*c* of the shield 41 as the separating member is extended towards the surface of the fixing belt 31 to be longer than the second wall 41*d* of the shield 41 at the opposite side to the conveying path 10. For example, the first wall 41*c* may be formed to be actually longer than the second wall 41*d*. Incidentally, the needle electrode 40 is disposed so that the tip ends 40*a* are protruded slightly more than the second wall 41*d*. The tip end aperture 41*a* is provided between both tip ends of the first wall 41*c* and the second wall 41*d*, and is close to the surface of the fixing belt 31 at the first wall 41*c*'s side rather than the second wall 41*d*'s side.

In the fixing device 13, in general, at the downstream side from the fixing nip N in the conveyance direction of the sheet, there is a need to cause the ejecting section 26 to be close to the fixing nip N in order to save a space, and to provide the separating member separating the sheet from the fixing member 21 (the fixing belt 31) and the pressing member 22. Therefore, it is difficult to ensure an installation space of other members. However, in the other embodiment as described above, since the first wall 41*c* of the shield 41 is compatible with the separating member, it is possible to dispose the charger 24 while achieving space saving.

Although the embodiment was described as to an example of the needle electrode 40 formed in the serrated shape, the needle electrode 40 is not restricted by this example. For instance, in another different embodiment, the needle electrode 40 may be configured while a plurality of needle members are disposed at predetermined intervals along the width direction of the fixing belt 31.

Although the embodiment was described as to a configuration in which the heating member 23 of the IH fixing unit is provided as the heat source heating the fixing member 21, the heat source is not restricted by this configuration. For example, in another different embodiment, another heat source, such as a halogen heater or a ceramic heater, may be provided.

Although the embodiments was described about a case applying the configuration of the present disclosure to the color printer 1, in another different embodiment, the configuration of the present disclosure may be applied to another image forming apparatus, such as a monochrome printer, a copying machine, a facsimile and a multifunction peripheral.

Further, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a fixing member rotatably provided and heated by a heat source;

a pressing member rotatably provided and brought into pressure contact with the fixing member to form a fixing nip through which a sheet having a toner image is passed;

a charger disposed to oppose to the fixing member and applying an electric charge of the same polarity as a toner constituting the toner image to a surface of the fixing member; and an air discharging device discharging an air flow passed between the fixing member and the charger via a filter, wherein the charger is disposed at a downstream side from the fixing nip in a rotation direction of the fixing member, the charger further includes an intake port provided between an electrode applying the electric charge and a shield surrounding a periphery of the electrode at a proximal end side of the electrode to take air in, the intake port communicates to the air discharging device via a tip end side of the electrode.

2. The fixing device according to claim 1, wherein the charger is configured so that a tip end aperture of the shield is oriented to the fixing member and a proximal end aperture of the shield is provided at a vicinity of a downstream side from the fixing nip in a conveyance direction of the sheet.

3. The fixing device according to claim 1, wherein the shield is configured so that a wall at a conveying path side of the sheet is compatible with a separating member separating the sheet from the fixing member.

4. The fixing device according to claim 1 further comprising:

an ejection guide guiding to an ejecting section the fixed sheet passed through the fixing nip, wherein the ejection guide is provided with a guide aperture in a vicinity of a proximal end aperture of the shield.

5. The fixing device according to claim 1, wherein the air discharging device includes a dust collecting electrode in an air discharging duct.

6. An image forming apparatus comprising:

the fixing device according to claim 1.

7. An image forming apparatus comprising:

the fixing device according to claim 2.

8. An image forming apparatus comprising:

the fixing device according to claim 3.

9. An image forming apparatus comprising:

the fixing device according to claim 4.

10. An image forming apparatus comprising:

the fixing device according to claim 5.

* * * * *